US006264561B1

(12) United States Patent
Saffari et al.

(10) Patent No.: US 6,264,561 B1
(45) Date of Patent: Jul. 24, 2001

(54) ELECTRONIC GAME LICENSING APPARATUS AND METHOD

(75) Inventors: Ali M. Saffari; Mark Y. Lam; Mark R. Cass, all of Reno; Robert W. Crowder, Las Vegas, all of NV (US)

(73) Assignee: International Game Technology, Reno, NV (US)

( * ) Notice: Subject to any disclaimer, the term of this patent is extended or adjusted under 35 U.S.C. 154(b) by 0 days.

(21) Appl. No.: 09/164,861

(22) Filed: Oct. 1, 1998

(51) Int. Cl.[7] ..... A63F 9/22

(52) U.S. Cl. ..... 463/42; 463/41; 463/16; 463/17; 463/18; 463/19; 463/20; 273/439

(58) Field of Search ..... 463/40, 42, 12–13, 463/16–20; 273/439

(56) References Cited

U.S. PATENT DOCUMENTS 4,593,376 * 6/1986 Volk ..... 364/900
5,203,848 * 4/1993 Wang ..... 273/435
5,613,089 * 3/1997 Hornbuckle ..... 395/491
5,632,681 * 5/1997 Bakoglu et al. ..... 463/44
5,655,961 * 8/1997 Acres et al. ..... 463/27
5,737,418 4/1998 Saffari et al. ..... 380/9
5,944,608 * 8/1999 Reed et al. ..... 463/40
5,951,397 * 9/1999 Dickinson ..... 463/36

* cited by examiner

*Primary Examiner*—Valencia Martin-Wallace
*Assistant Examiner*—Carmen D. White
(74) *Attorney, Agent, or Firm*—Beyer Weaver & Thomas

(57) ABSTRACT

A use enabling method and mechanism to enable use of a disabled game resident on multiple platform gaming machines. When a gaming operator elects to enable a particular disabled game, an enabling device of generates an encrypted Request Code (27) having components identifying the specific gaming machine and the specific game to be enabled. This Request Code (27) is then communicated through a communication coupling (55) to a compatible, mating encoder device (28) operated by the licensing game vendor or game manufacture. In response, the encoder device (28) generates an encrypted Enabling Code (31) which enables use only for the selected game or games, and only in the gaming machine (21) upon which the corresponding Request Code originated. Upon inputting the corresponding Enabling Code (31) into the enabling device (32) incorporated on the particular gaming device, the selected disable game or games may be subsequently enabled for use.

40 Claims, 8 Drawing Sheets

ELECTRONIC GAME LICENSING APPARATUS AND METHOD

TECHNICAL FIELD

This present invention relates, generally, to remote location electronic gaming devices and, more particularly, relates to mechanisms and methods for enabling use of electronic games to be licensed and resident on the remote electronic gaming devices.

BACKGROUND ART

In the recent past, gaming machines have become increasingly sophisticated. The once traditional mechanically-driven reel slot machines are often replaced with electronic counterparts having computer driven games with spinning reel display devices, CRT video displays or the like. Moreover, these electronic gaming advancements enable the operation of more complex gambling games which would not otherwise be possible on mechanical-driven gambling machines. Such stand alone electronic games include spinning reel games, Slot, Keno, Blackjack, Poker, Pai Gow, video spinning reel games and all the variations thereof.

More recently, multiple game platforms have been developed which provide access to multiple electronic games through a single stand alone gaming machine. A game selection menu may be provided on a video display which offers the patron the choice of at least two electronic games. The gaming patron, thus, may select a game of their choice without having to search the gaming establishment for the location of a desired game.

These games are usually stored in Erasable, Programmable, Read-Only Memory (EPROM) chip sets which are then incorporated into compatible gaming machines for operation thereof. Depending upon the licensing scheme negotiated between the machine manufacturer or game vendor and the gaming operator, any combination of selected video games may be licensed by the gaming operator. A number of free conventional games may also be bundled together with the licensed games on the EPROM chip set to offer a larger variety or package of games to the gaming operator and their patrons.

One problem associated with this design, however, is that depending upon the negotiated selected games, a separate EPROM set must be provided in each instance. For example, if the licensed games included were Blackjack, Poker and Keno, a specific EPROM set would be necessary incorporating only those three games. Should the gaming operator desire only Blackjack and Poker, another EPROM set is required which excluded Keno, etc.

In addition, each gaming alteration requires an EPROM chip set installment. This disincentive to alter the number of offered games also results in gaming machine downtime, as well as higher operating costs for the gaming operator and the risk of damaging EPROMS during removal or installation. The costs for the machine manufacturer or game vendor are also increased since they must supply several different EPROM chip sets having different combinations of games.

In contrast, if only one gaming EPROM were provided which contained a full set of games accessible by the gaming operator, the manufacturer or game vendor would have no means of controlling which games the gaming operator accessed or made available to their patrons. In this arrangement, an unlicensed game would be just as accessible as a licensed game.

Another problem associated with the EPROM chip set technology is that the EPROMs are easily copied. Any gaming operator could have the EPROMs reproduced and subsequently inserted into other compatible machines. Such reproductions are also difficult to control, and thus cause substantial loss of revenue to the manufacturer or licensor.

This is a serious concern for gaming machine manufacturers and gaming vendors alike. Accordingly, in view of the above observations, it would be desirable to provide a multiple game platform gaming machine which can easily enable the gaming machine manufacturer or vendor to control the licensing of the selected games. In addition, it would be desirable to reduce the costliness and inconvenience of providing a multitude of EPROM chip sets having differing combinations of accessible games.

DISCLOSURE OF INVENTION

The present invention provides a system and method for enabling use of at least one electronic game of a plurality of electronically disabled games which are operably accessible from a gaming machine. The method includes the steps of: (a) selecting an electronically disabled electronic game from the gaming machine; and (b) generating a Request Code representative of the particular selected electronic game on the particular gaming machine for input into an encoder device. The present invention then includes the steps of (c) receiving an Enabling Code responsive to the Request Code and calculated by the encoder device specifically for the particular gaming machine; and (d) inputting the Enabling Code, representing information electronically enabling operation of the previously disabled electronic game for that gaming machine, into the gaming machine to enable operation of the selected game.

In one embodiment, the generating step may further include the step of generating an input machine identification component, an input game identification component and an input time period component, all of the Request Code. Briefly, the input machine identification component represents the identification of a particular gaming machine, while the input game identification component represents the selected game to be enabled. Finally, the input time period component of the Request Code represents a predetermined time for enabling use of the selected game.

Similarly, in another embodiment, the Enabling Code includes a corresponding output game identification component, an output machine identification component and an output time period component. The output game identification component is generated in response to the input game identification component of the Request Code which enables use of the selected electronic game. The output machine identification component is generated in response to the input machine identification component of the Request Code which enables use of the selected electronic game on the particular gaming machine. Finally, the output time period component is generated in response to the input time period component of the Request Code which enables use of the selected electronic game for a predetermined time period on the particular gaming machine.

The gaming machine may be coupled to an enabling device which is configured to generate the Request Code. This enabling device preferably includes a clock device responsive to the output time period component of the Enabling Code to enable use of the selected game for the predetermined time period. To prevent attempts to circumvent the internal clock device, upon manual resetting of the clock device a predetermined number of times, the enabling device may automatically disable use of the selected game.

In another configuration, the generating step further includes the step of encrypting the Request Code through an encrypting device communicably coupled to the enabling device. Upon receipt of the encrypted Enabling Code, the method further includes the step of decrypting the Enabling Code through a decrypting device communicably coupled to the enabling device to retrieve the Enabling Code data.

In yet another embodiment of the present invention, a method for enabling use of at least one electronic game of a plurality of electronic games is provided which is operably accessible from a gaming machine. The method includes the steps of: (a) receiving a Request Code generated by the gaming machine, representing the identification of a selected, electronic game to be licensed on the particular gaming machine; and (b) inputting the received Request Code into an encoder device. The method of the present invention further includes the step of (c) responsive to the input Request Code, generating an Enabling Code representing data electronically enabling operation of the previously disabled electronic game for input into that particular gaming machine for licensed operation thereof.

In still another aspect, a gaming machine is provided including a display device, and an electronic multiple-game platform having at least one disabled electronic game coupled to the display device and operably accessible from the gaming machine. An enabling device is coupled to the multiple-game platform which is configured to selectively enable the disabled electronic game upon receipt of an Enabling Code corresponding to the disabled electronic game. The enabling device is adapted to generate a Request Code upon which the Enabling Code is generated in response to receipt of the Request Code. Further, an encoder device is adapted to generate the Enabling Code which is communicably coupled to the enabling device.

In one embodiment of the gaming machine, a clock device is included which is responsive to the output time period component of the Enabling Code to enable use of the selected game for the predetermined time period. The clock device is coupled to the enabling device in a manner such that upon manual resetting thereof a predetermined number of times, the enabling device automatically disables use of the enabled electronic game.

In another configuration, a gaming machine is includes a display device, and an electronic multiple-game platform having at least one disabled electronic game coupled to the display device and operably accessible from the gaming machine. The gaming machine further includes an enabling device coupled to the multiple-game platform and configured to selectively generate a Request Code corresponding to the disabled electronic game to enable operation thereof. The Request Code is further generated in response to a request to enable operation of the disabled electronic game.

BRIEF DESCRIPTION OF THE DRAWINGS

The method and assembly of the present invention has other objects and features of advantage which will be more readily apparent from the following description of the Best Mode of Carrying Out the Invention and the appended claims, when taken in conjunction with the accompanying drawing, in which:

BEST MODE OF CARRYING OUT THE INVENTION

Figure 1:
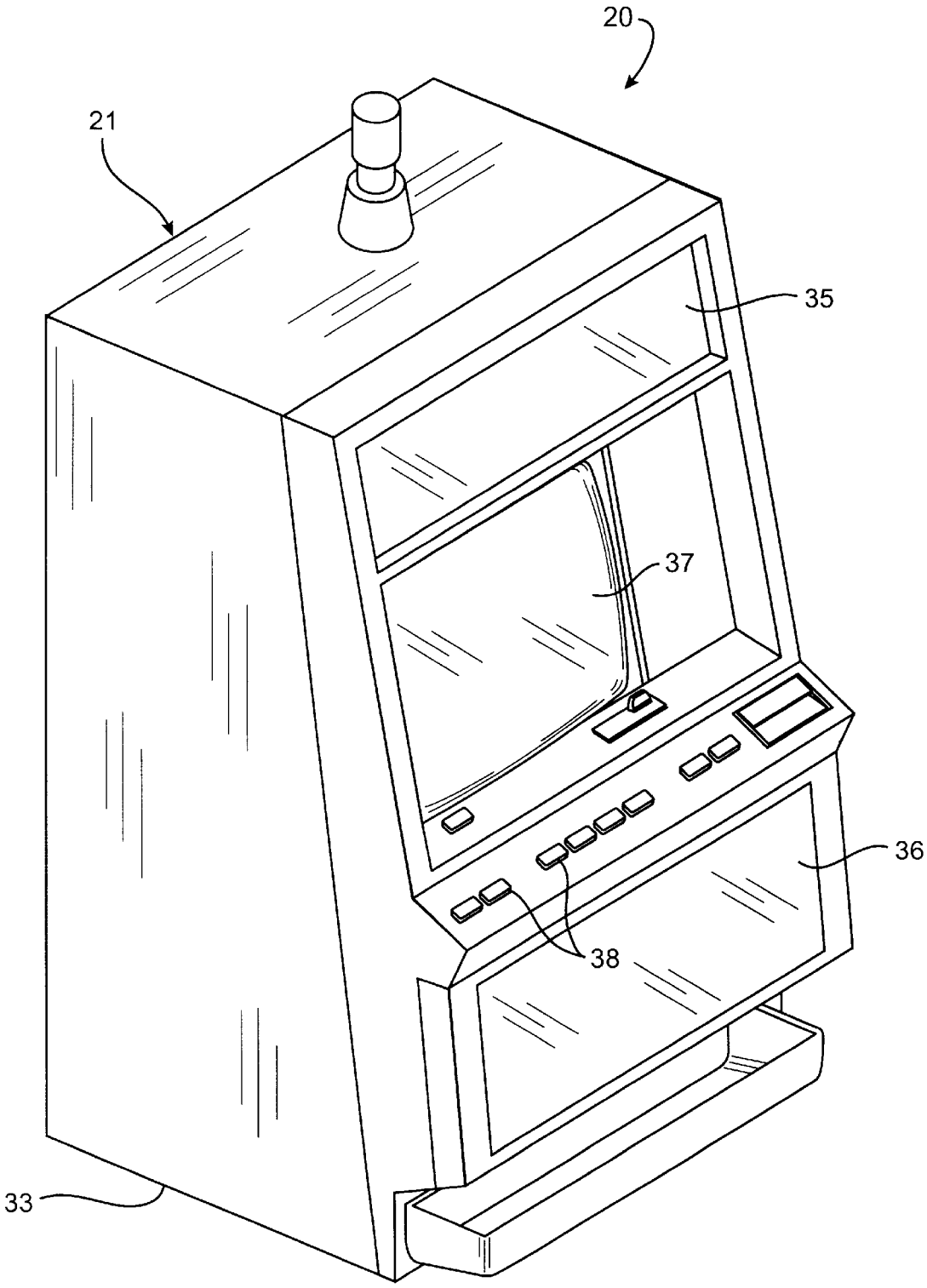
FIG. 1 is a top perspective view of a conventional gaming machine incorporating a multiple platform EPROM chip set, and a licensing mechanism and method designed in accordance with one embodiment of the present invention.

While the present invention will be described with reference to a few specific embodiments, the description is illustrative of the invention and is not to be construed as limiting the invention. Various modifications to the present invention can be made to the preferred embodiments by those skilled in the art without departing from the true spirit and scope of the invention as defined by the appended claims. It will be noted here that for a better understanding, like components are designated by like reference numerals throughout the various figures.

1. Brief Overview

Attention is now directed to FIGS. 1–4 where the present invention device use enabling or licensing mechanism and method, generally designated 20, is illustrated for enabling use of at least one electronic gaming device from a plurality of electronic gaming devices. Preferably, these devices are in the form of games having video capabilities provided at gaming establishments which are operably accessible from multiple format gaming machines 21 (FIG. 1). However, the use enabling mechanism and method of the present invention may also be used in connection with other video formats such as spinning reel devices with video bonussing capabilities such as the Vision Series Machines manufactured by IGT or video games at arcades or the like.

Figure 3:
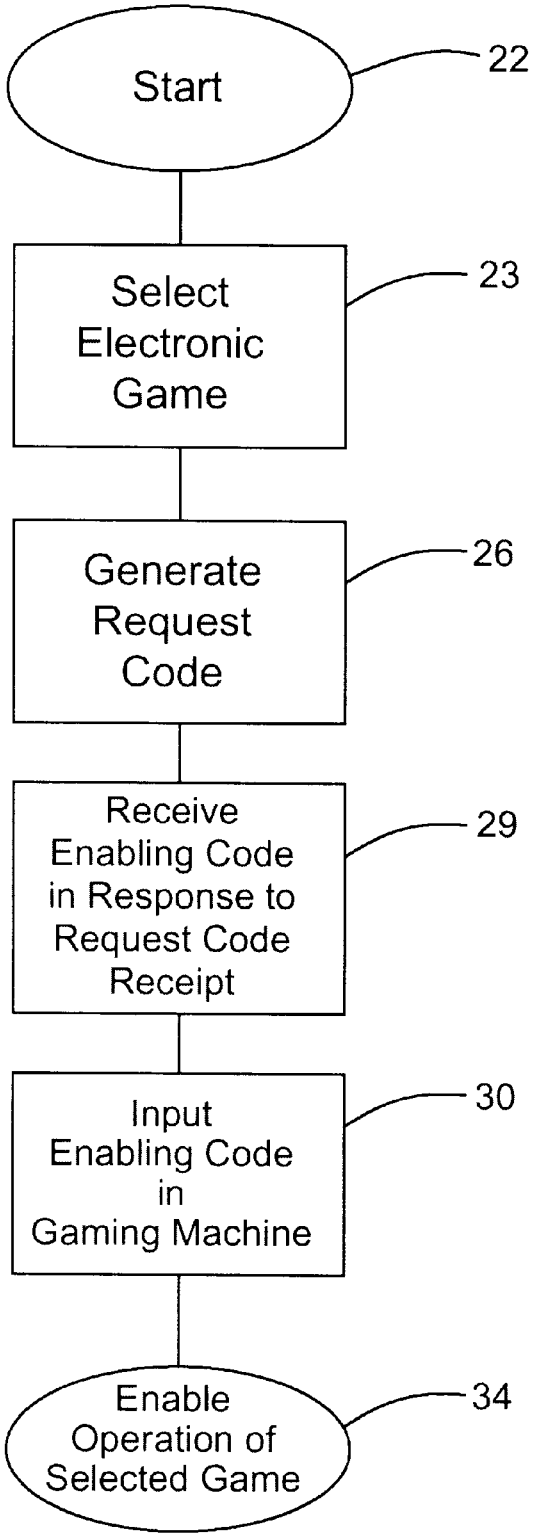
FIG. 3 is a process flow diagram setting forth the primary steps employed in the electronic game licensing mechanism of the present invention.

Briefly, as set forth in the flow diagram of FIG. 3, the principal steps of present inventive method begins at start step 22 and proceeds to step 23 which includes selecting an electronically disabled electronic game 25 from the gaming machine 21. The next step 26 includes generating a Request Code 27 representative of the particular selected electronic game 25 on the particular gaming machine 21 for input into an encoder device 28. After the Request Code generating step 26, the next step 29 includes receiving an Enabling Code 31, responsive to the Request Code 27 and calculated by the encoder device 28 specifically for the particular gaming machine 21. The final principal step 30 is provided by inputting the Enabling Code 31 into the gaming machine 21 to enable operation of the selected game 25 at step 34.

Employing the present mechanism and method, each selected game of a plurality of available games from each of a plurality of multiple platform gaming machines 21, 21' 21", etc. may be easily enabled or disabled for operation. As shown in the schematic diagram of FIG. 2, when a gaming operator elects to enable a particular electronically disabled game resident on a particular gaming machine 21, an enabling device of the present invention generates an encrypted Request Code 27 having components identifying the specific gaming machine and the specific game to be enabled. This Request Code 27 is then communicated through the telephone, internet, wireless transmission, hardwiring, etc., to a compatible, mating encoder device 28 operated by the licensing game vendor or game manufacturer. In response, the encoder device 28 generates an encrypted Enabling Code 31 which enables use only for the selected game or games, and only in the gaming machine 21 upon which the corresponding Request Code originated. Upon inputting the corresponding Enabling Code 31 into the enabling device 32 incorporated on the particular gaming device, the selected electronically disabled game or games may be subsequently enabled for use.

Accordingly, a game device enabling or licensing mechanism and method are provided which enable the machine manufacturer or gaming vendor to more easily restrict and/or enable the operable use of selected games on any particular gaming machine. Such an enabling mechanism and method is especially suitable for multiple video game formats operated from a single gaming machine. This arrangement is even beneficial should an EPROM chip set incorporating the multitude of games be copied and installed in another compatible gaming machine. The machine manufacturer or gaming vendor may therefore more reliably charge for the number of copies the gaming operator may create and use. Moreover, this arrangement is also advantageous to the gaming operator since any licensed or unlicensed game accessible through the EPROM chip set may be easily enabled or disabled without requiring EPROM chip set replacement.

2. Physical Embodiment

Embodiments of the present invention as described above employ various operations involving data stored in computer systems or processors of video devices and encoder devices for example. Useful machines for performing the operations of this invention include digital computing systems or other data processing devices. Such apparatus may be specially constructed for the required purposes, or it may be a general purpose computing system selectively activated or reconfigured by a computer program stored in the computer. The processes presented herein are not inherently related to any particular computing system or other apparatus. In particular, various general purpose machines may be used with programs (including programmed EPROMs for example) written in accordance with the teachings herein, or it may be more convenient to construct a more specialized apparatus to perform the required method steps. The required structure for a variety of these machines will appear from the description given above.

In addition, embodiments of the present invention further relate to computer readable media that include program instructions for performing various computer-implemented operations. The media and program instructions may be those specially designed and constructed for the purposes of the present invention, or they may be of the kind well known and available to those having skill in the computer software arts. Examples of computer-readable media include, but are not limited to, magnetic media such as hard disks, floppy disks, and magnetic tape; semiconductor memory, optical media such as CD-ROM disks; magneto-optical media such as optical disks; and hardware devices that are specially configured to store and perform program instructions, such as read-only memory devices (ROM) such as flash memory devices, EEPROMs, EPROMs, etc. and random access memory (RAM). Examples of program instructions include both machine code, such as produced by a compiler, and files containing higher level code that may be executed by the computer using an interpreter.

Briefly, referring back to FIG. 1, a conventional video display gaming machine 21 is provided in accordance with one embodiment of this invention which is capable of supporting a multi-game machine format, such as International Game Technology's (IGT) "Game King Machine" or "Vision Series Machine". It will be appreciated, of course, that any other multi-game machine format may be employed as well. Gaming machine 21 may include a gaming machine housing 33, a top glass 35, a belly glass 36, and a main video display 37. Main video display 37 may be provided by high-resolution flat panel Liquid Crystal Displays (LCD), Cathode Ray Tubes (CRT), projection type LCDs, plasma displays, field emission displays, digital micromirror devices (DMD) or other conventional electronically controlled video monitors. Examples of games for which the results of a play may be displayed on a main video display include video slot games, electronic video poker card games, electronic keno games, electronic blackjack games, spinning reel slot games, increasingly popular multi-line machines which have multiple (e.g., 8 or 15) pay lines or electronic spinning reel games with video bonussing features.

Provided beneath main display 37 are various play buttons 38 which allow the user to control operation of the gaming machine in a conventional manner. The control buttons 38 allow the gaming machine user to select various games and/or game options. Of course, the arrangement and function of control buttons 38 will depend somewhat upon the type of game (or games) that can be played on machine 21, and buttons 38 may have more than one function depending on the available games.

The host gaming machine 21 preferably includes a CPU board 40 (FIG. 4) having the necessary processors and memory to execute the coded instructions to operate the multitude of available games. The CPU board 40 also executes the coded instructions to enable and/or disable the available games in accordance with the present invention. The processor will, of course, act on these instructions to generate the appropriate signals, such as the generation of the Request Code 27, as well as enable access to the selected game upon receipt of the Enabling Code 31.

Figure 4:
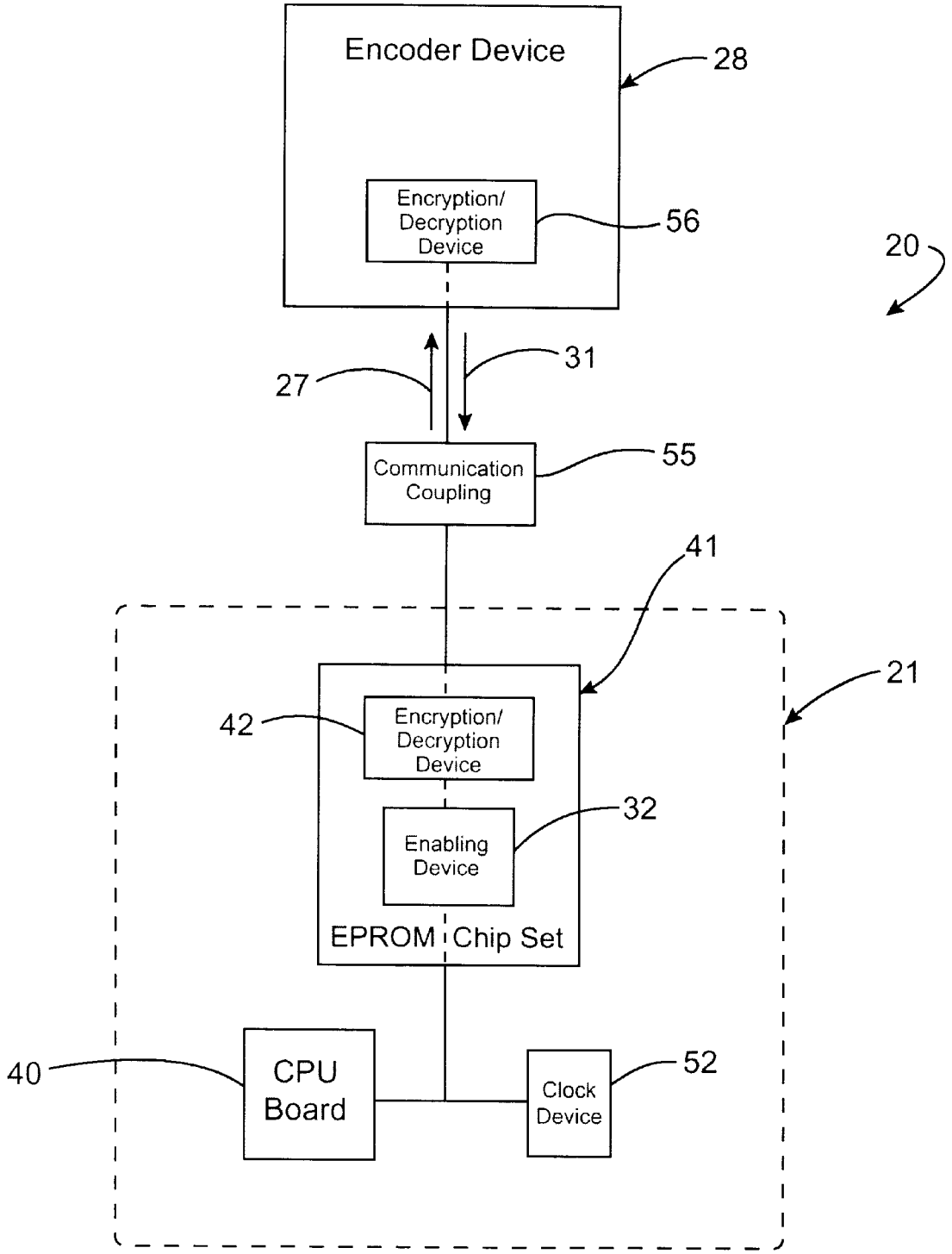
FIG. 4 is a detailed schematic representation of the electronic game licensing mechanism and method of FIG. 2.

Turning now to FIG. 4, the use enabling mechanism 20 of the present invention is illustrated in schematic form having an EPROM chip set 41 of the present invention configured to be compatibly installed into gaming machine 21. Preferably, each chip set includes a set of game chips which provide the specific information to operate the available games for display and operation on the gaming machine. Briefly, incorporated in these memory chips are the instruction sets and graphics necessary for game operation of each game of the multiple game format. A second set of chips included in EPROM chip set 41 is a set of pay table/configuration chips which provide code instructions for button operation, pay table schemes and various menu operations.

The game chips and configuration chips cooperate with the remaining components of the EPROM chip set 41 to form an enabling device 32 in accordance with the present invention. This device 32 provides the necessary code instructions and information to electronically enable and/or disable the games to be licensed. The code of all these chips of the EPROM chip set are preferably executed on the CPU board 40 of the gaming machine which, for example, generates the corresponding enabling menus (FIGS. 5–10). These menus communicate the licensing status as well as provide game enabling or disablement information of the available games to the operator.

Moreover, the enabling device 32 further provides the necessary code and algorithms to generate, employing the CPU board 40, the particular Request Codes 27. Similarly, this device provides the necessary code and algorithms to decipher the received Enabling Code 31 which enables access to the selected electronically disabled video game on a particular gaming machine 21.

To store the licensing database, the EPROM chip set includes sufficient RAM chips to store instructions to control the period of time enabling operable use of the enabled game, the Enabling Code and Request Code for each licensed game, as well as the denomination of each game for that particular gaming machine. Finally, an encrypting/decrypting device 42 may be provided to encrypt the outgoing Request Code 27, as well as decrypt the incoming Enabling Code 31.

Figure 2:
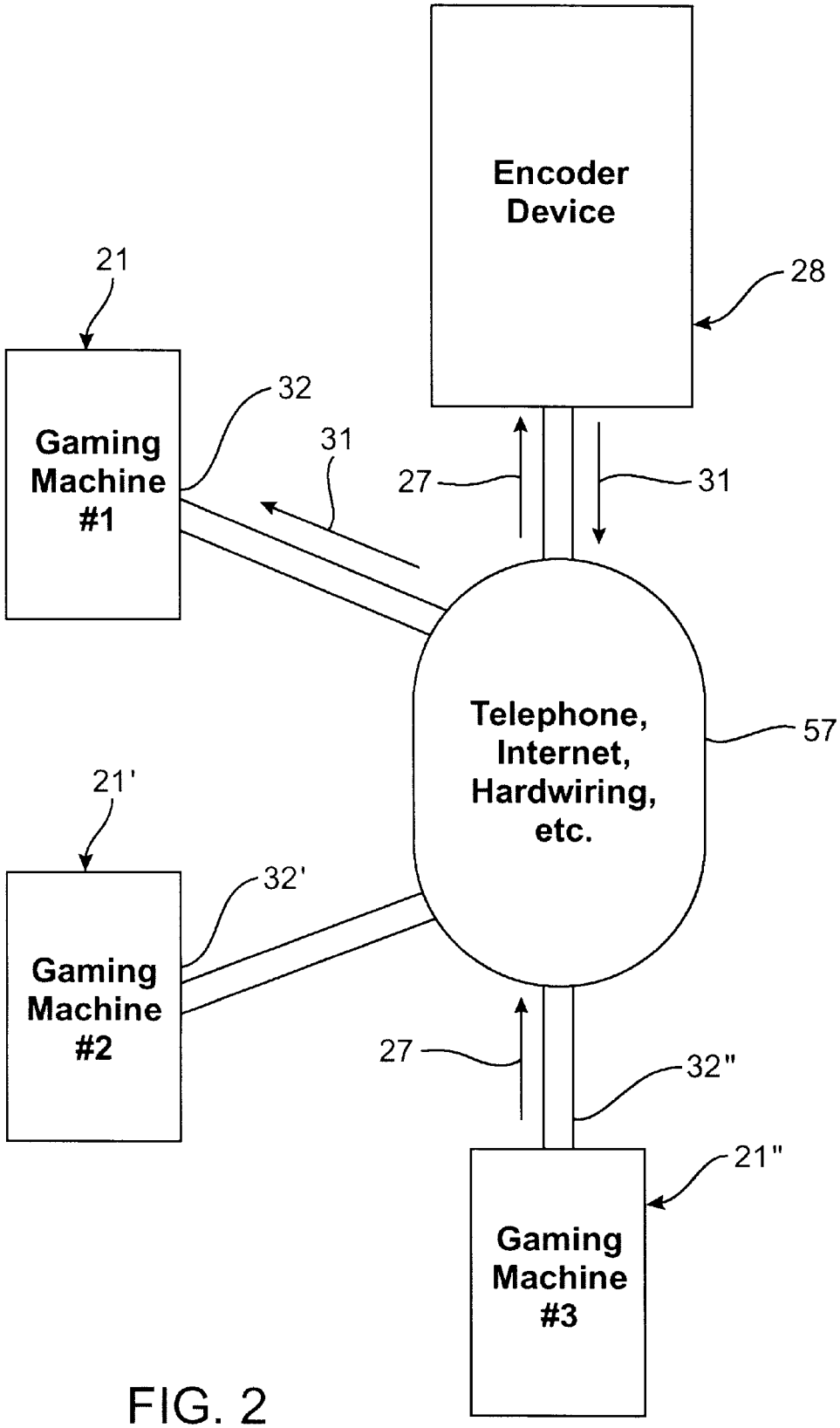
FIG. 2 is a schematic representation of the electronic game licensing mechanism and method designed in accordance with the present invention.

FIGS. 2 and 4 best illustrate that a compatible, mating encoder device 28 is selectively in communication with the EPROM chip set 41 of the gaming machine 21. This encoder device 28 is adapted to receive the Request Code 27 generated by the enabling device 32, and in response, generates a corresponding Enabling Code 31 specific for input back into the enabling device 32 of origin of the Request Code 27 to enable use of the selected electronic game. This encoder device 28 is preferably in the form of a computer program which is capable of execution on a conventional PC or the like. Similar to the EPROM chip set 41, the encoder device 28 preferably includes compatible encryption/decryption to decrypt the incoming Request Code 27 and to encrypt the outgoing Enabling Code 31.

3. Licensing Data Formats

Figure 5:
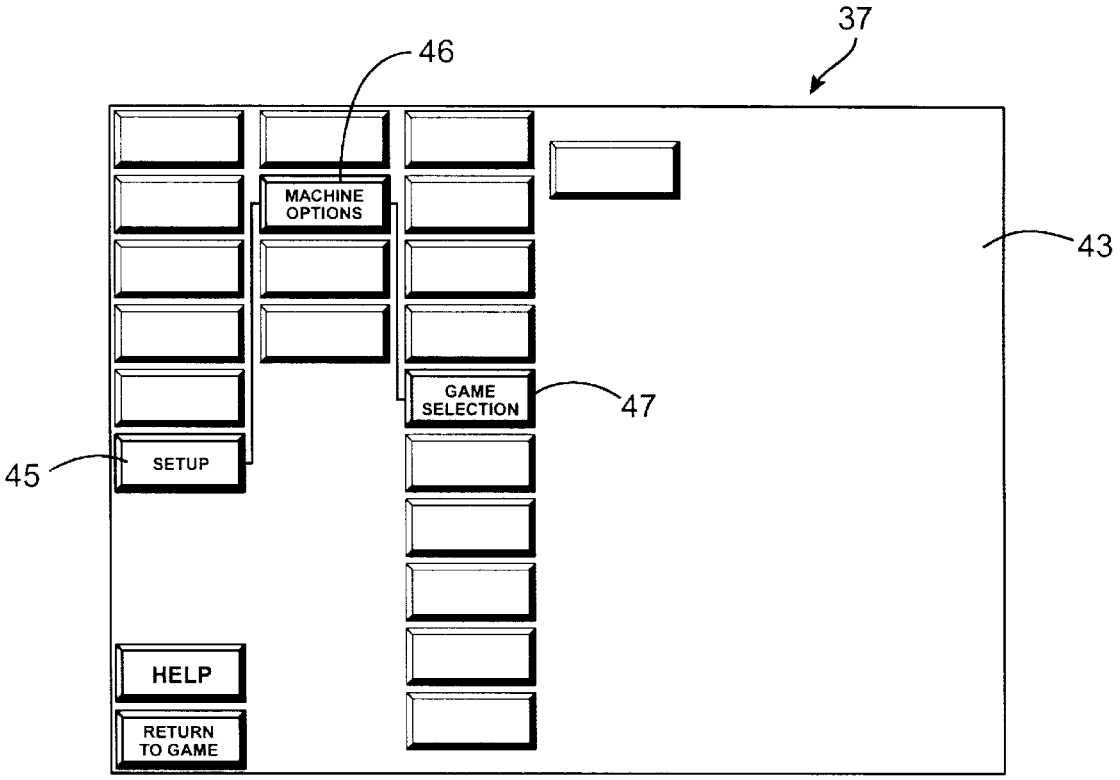
FIG. 5 is a representation of a SETUP menu as viewed from a gaming machine incorporating the licensing mechanism of the present invention.
Figure 6:
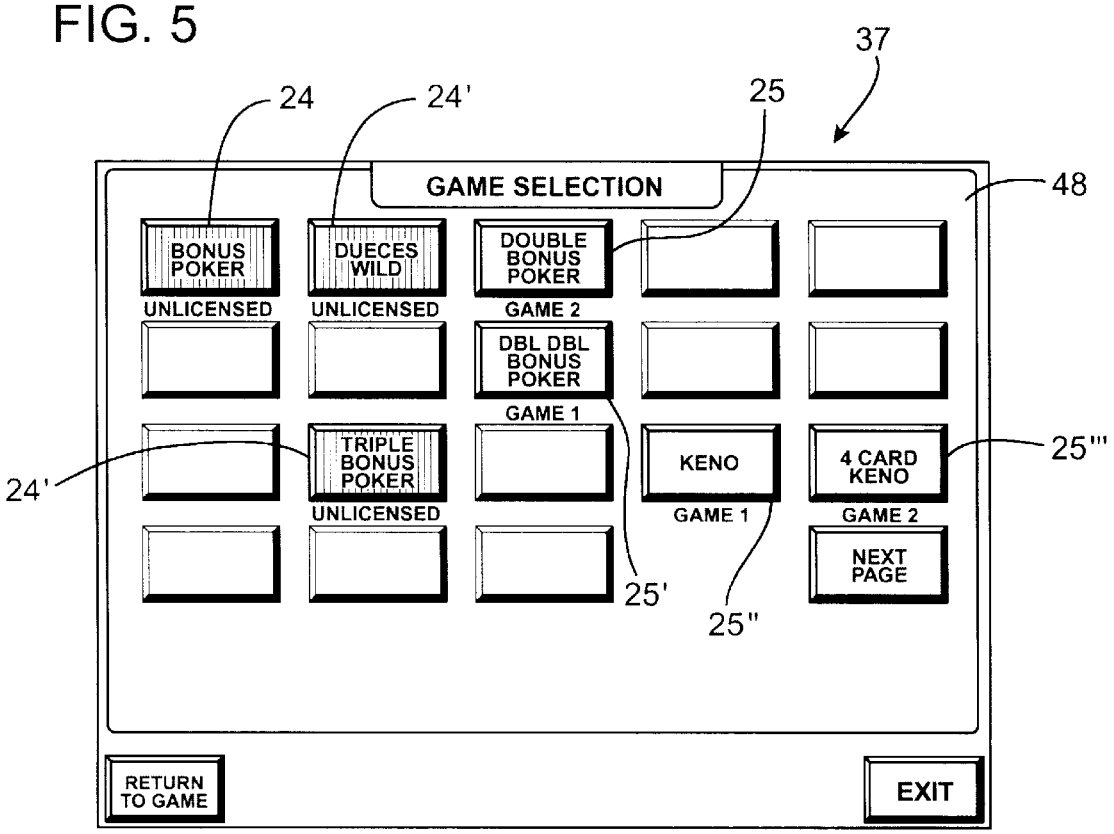
FIG. 6 is a representation of a GAME SELECTION menu of the present invention illustrating all licensed and unlicensed games which are accessible through the gaming machine.
Figure 7:
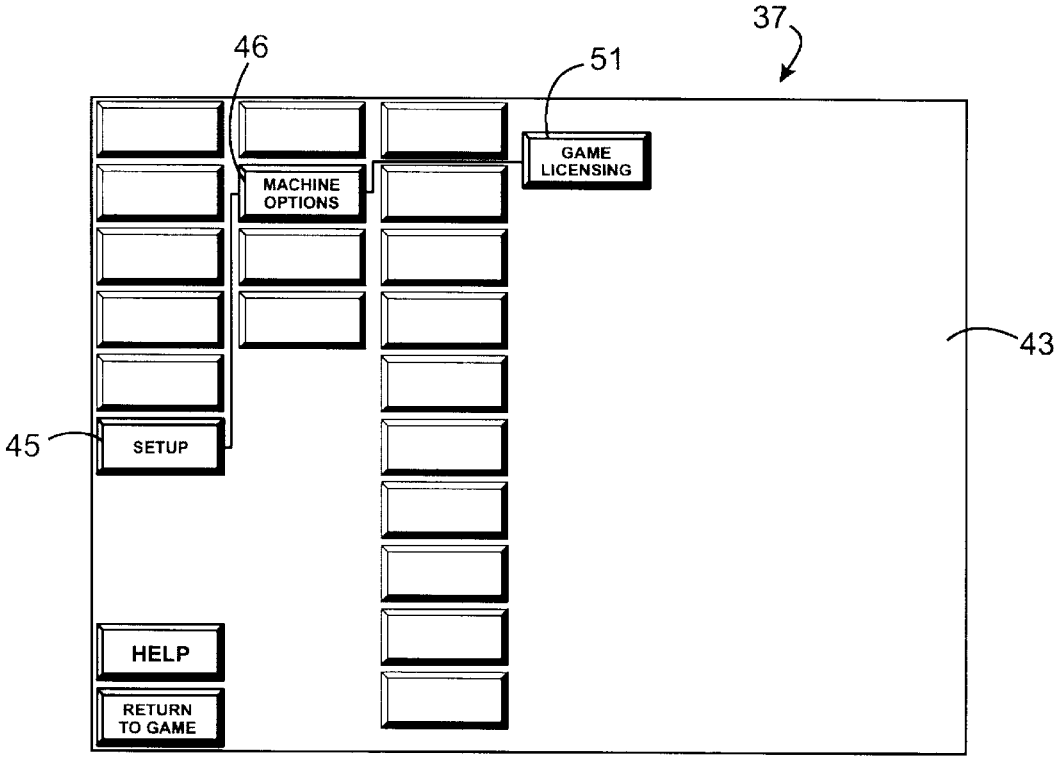
FIG. 7 is another representation of a SETUP menu prompting the Operator whether or not to initiate a new license.

Referring now to FIG. 5, an operator SETUP menu 43 is illustrated which is accessible to only the gaming operator for viewing on display 37. This SETUP menu 43 enables the gaming operator to view the available games (as shown in FIG. 6) which the game chips and the pay table/configuration chips of the EPROM chip set 41 cooperate to provide. Upon selection (preferably touchscreen) of the shown sequence of the SETUP button 45, the MACHINE OPTIONS button 46 and the GAME SELECTION button 47 from the SETUP menu 43, the GAME SELECTION menu 48 will be accessed as viewed in FIG. 6.

Accessing the pay table/configuration chips, this menu informs the operator of the licensing status of the available games which are provided by the EPROM chip set 41. As exemplified in the GAME SELECTION menu 48, the DOUBLE BONUS POKER game 25, DBL DBL BONUS POKER game 25', KENO game 25" and 4 CARD KENO game 25'" are currently enabled or licensed for use. Therefore, should the gaming operator desire to offer any combination of these licensed games to their patrons, the desired combination of licensed games may be selected from the corresponding buttons on the GAME SELECTION menu 48. Consequently, the selected games will be accessible and enabled for use by the gaming operator's patrons, including any additional "free" games offered by the manufacturer or game vendor.

In contrast, the enabling status of the BONUS POKER game 24, DEUCES WILD game 24' and TRIPLE BONUS POKER game 24" are illustrated as being "unlicensed", and thus cannot be enabled by the operator. Should the corresponding buttons of any of these unlicensed games be selected by the operator from the GAME SELECTION menu 48, the machine logic of the EPROM chip set 41 will indicate that the electronically disabled games are not yet licensed. In the preferred embodiment, the instruction set of the chip set enabling device 32 will then prompt the operator to enter the GAME LICENSING menu 50, as viewed in the SETUP menu 43 of FIG. 7, in order to license the selected electronically disabled game. The gaming operator may then determine whether or not to initiate the process of licensing any of the unlicensed games by selecting the GAME LICENSING button 51.

Figure 8:
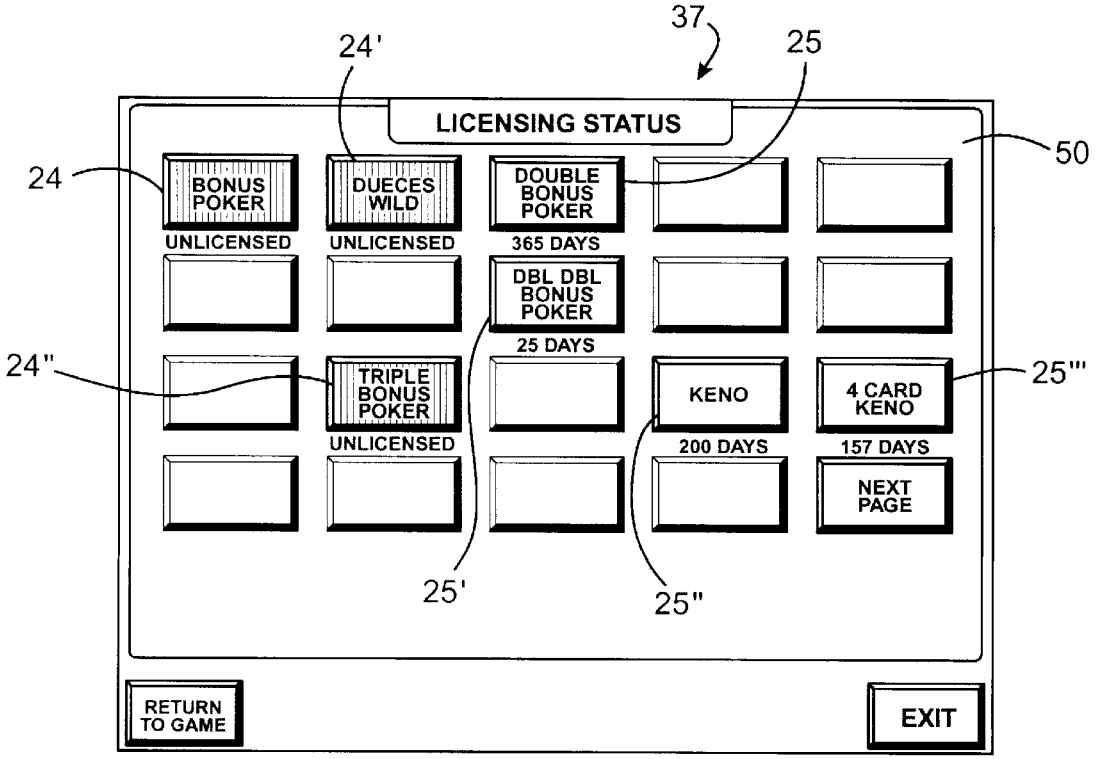
FIG. 8 is a representation of a LICENSING STATUS menu of the present invention illustrating the status of all licensed and unlicensed games resident on the gaming machine.
Figure 9:
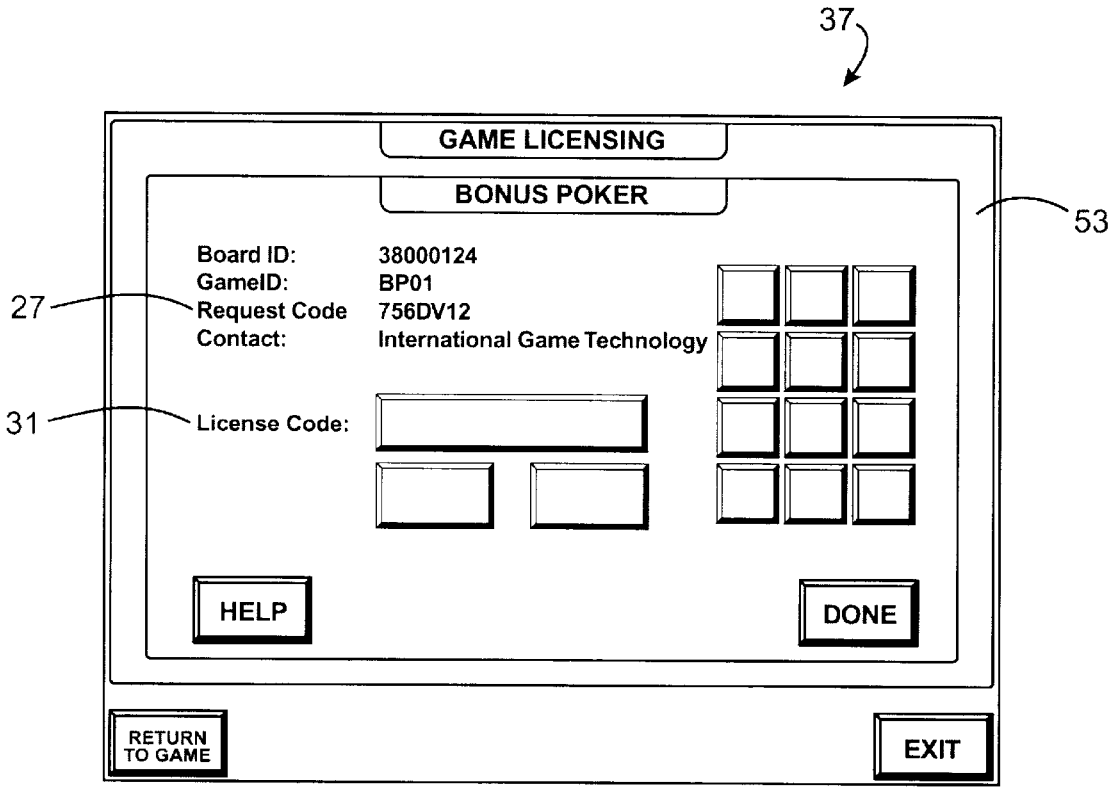
FIG. 9 is a representation of a GAME LICENSING menu of the present invention after calculation of the Request Code.

Upon selecting the GAME LICENSING button 51 in the SETUP menu 43, a LICENSING STATUS menu 50 (FIG. 8) will be accessed which expresses the licensing status of all the "licensed" and "unlicensed" games. This menu may also display the status of all "free" games provided by the game manufacturer or gaming vendor in the EPROM chip set 41 as well. Preferably, the LICENSING STATUS menu 50 includes additional information about the "licensed games", such as the remaining time period of the corresponding license for the licensed games. As shown in FIG. 8, for example, 365 days remain on the license for the DOUBLE BONUS POKER game 25, while 200 days remain on the license for the KENO game 25". Briefly, as will be described in greater detail below, the RAM incorporated in EPROM chip set 41 and internal clock device 52 in the gaming machine 21 cooperate to independently track and monitor the operational time period of each licensed game.

In accordance with the present invention, when an unlicensed game such as the BONUS POKER game 25 is selected from the LICENSING STATUS menu 50 (FIG. 8), the algorithms incorporated in the enabling device 32 of the EPROM chip set 41 communicate with the CPU board 40 of the gaming machine 21 to generate a specific Request Code 27. Each Request Code 27 is specific to a particular gaming machine, and specific to a particular video game or bonus. Accordingly, the Request Code 27 preferably includes an input machine identification component which specifically identifies the particular gaming machine from which the Request Code 27 originated.

To specifically identify each gaming machine, a Board ID number specific to that machine is incorporated into non-volatile memory devices residing in the CPU board and/or motherboard. During the Request Code calculation, the enabling device 32 then preferably incorporates this Board ID number as the input machine identification component part of the Request Code 27. In the example illustrated in the GAME LICENSING menu 53 of FIG. 9, the Board ID accessed from gaming machine 21 is "38000124".

Similarly, the generated Request Code 27 preferably includes an input game identification component which specifically identifies the particular "unlicensed" game (E.g., the BONUS POKER game 25) to be enabled. This Game ID number may be accessed from the EPROM chip set 41 installed on the particular machine. As viewed in the GAME LICENSING menu 53 of FIG. 9, the Game ID number accessed from the EPROM chip set is "BP01". The enabling device 32 subsequently preferably incorporates this Game ID number as the input game identification component part of the Request Code 27.

It will be further understood that the Request Code may include any combination of information components which the game machine manufacturer or game vendor may deem necessary to license their game or games. For instance, the Request Code may optionally include an input time period component relating to the requested time period or term of the license. This predetermined period of time may of course be negotiated and is easily altered by corresponding output informational component of the Enabling Code 31. Other informational components may be included for licensing customization which include the licensing fee, denomination requests, or pay tables.

Yet another optional information component may include a time and date component relating to the time and date the Request Code was generated. Hence, the generated Request Code may change from day-to-day regardless of whether the same game of the same gaming machine is selected for licensing. In this instance, since it may not always be convenient for the gaming operator to immediately communicate the Request Code to the game manufacturer or vendor, the enabling information of the enabling device 32 may remain valid until a predetermined time, such as midnight. This preset time period will allow the gaming operator sufficient time to record the information, leave the displayed information, communicate the Request Code to the licensor at a later time, and then reenter the GAME LICENSING menu 53 to enter the Enabling Code before midnight.

Many of these components, however, may be communicated to the manufacturer or game vendor by means other than through the Request Code. Such components may include the Board ID, the term of the license, the license fee, the denomination, etc. These terms as well as other licensing conditions may be negotiated with the game licensor, or may be preset, as determined by the game manufacturer or game vendor. In some instances, regardless of the content of the Request Code 27, the informational components may be added to the corresponding Enabling Code 31 generated from the encoder device 28.

In the preferred embodiment, the Request Code 27 will be encrypted for the benefit of both the game manufacturer or game vendor and the gaming operator. As shown in FIG. 4, the EPROM chip set includes an encrypting/decrypting device 42 which encrypts the information contained in the Request Code 27 through conventional encryption techniques. The encrypted Request Code 27 is preferably provided by a large number in hexadecimal format (i.e., consisting of digits from 0 through 9, and alphabets A, B, . . . , Z). For example, as shown in the GAME LICENSING menu 53 of FIG. 9, the encrypted Request Code 27 corresponding to the particular gaming machine and the selected disabled electronic game is provided by "756DV12".

Referring back to FIGS. 2, 3, 4 and 9 and in accordance with the present invention, once the encrypted Request Code 27 is generated and obtained from the enabling device 32, it must be communicated to the corresponding encoder device 28. Such communication of the Request Code to the encoder device may be accomplished using any communication medium such as voice transmission, telephone, internet, wireless transmission, hardwiring, facsimile, etc. This is clearly illustrated in FIG. 2 where a plurality of gaming machines 21, 21' and 21" are communicably coupled to the encoder device 28 through communication coupling 55.

In the preferred form of the present invention, the encoder device 28 includes a mating encrypting/decrypting algorithm or device 56 which is compatible to the encrypting/decrypting device 42 incorporated in the enabling device 32 of the EPROM chip set 41. The encrypting/decrypting devices 42 and 56 are of course, specific to that establishment so that the content of the incoming Request Code and the outgoing Enabling Code may be maintained in secrecy.

As stated above, the encryption may be performed using any conventional encryption technology. Similarly, the encrypted Enabling Code 31 is preferably provided by a large number in hexadecimal format (i.e., consisting of digits from 0 through 9, and alphabets A, B, . . . , Z). For example, as shown in the GAME LICENSING menu 53 of FIG. 10, the encrypted Licensing or Enabling Code 31 corresponding to the particular gaming machine and the selected disabled electronic game is provided by "534890013456".

FIGS. 2 and 4 best illustrate that once the encoder device 28 receives the encrypted Request Code 27, the encrypting/decrypting device 56 of the encoder device decrypts the Request Code 27 so that the content thereof can be used thereby. In response, the corresponding algorithms and code set incorporated in the encoder device 28 generate a corresponding Enabling Code 31. Similar to the Request Code 27, this Enabling Code 31 is a specific response for a particular gaming machine, and specific for a particular video game or games to be operably enabled. Accordingly, the Enabling Code 31 preferably includes an output machine identification component which specifically corresponds to the input machine identification component of the Request Code 27. This output machine identification component, therefore, specifically identifies the particular gaming machine upon which the Request Code 27 originated from, and upon which machine the corresponding Enabling Code is designated.

The Enabling Code 31 also preferably includes an output game identification component which corresponds to the input game identification component of the Request Code 27. This output game identification component specifically identifies the particular game which the Request Code 27 was directed toward, and upon which game the corresponding Enabling Code is designated. As above-indicated, additional information components may be manually or automatically included in the Enabling Code by the encoder device such as an output time period component and an output denomination component, etc.

Before the corresponding Enabling Code 31 is communicated to the communication coupling 55, it is preferably encrypted through the encrypting/decrypting device 56 of the encoder device 28. As viewed in FIGS. 2 and 4, such communication of the Enabling Code to the enabling device 32 may be accomplished using any communication medium such as the above-indicated voice transmission, wireless transmission, telephone, internet, hardwiring, facsimile, etc., but is preferably handled through a secure, dedicated transmission line.

Figure 10:
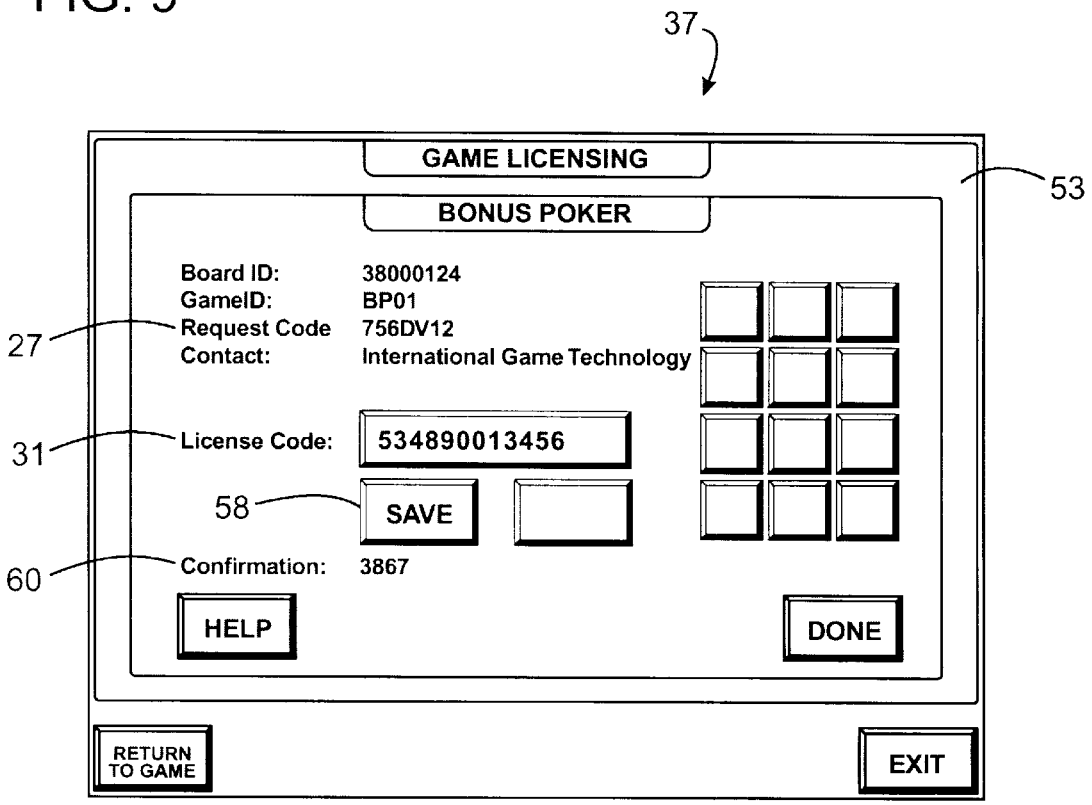
FIG. 10 is a representation of a GAME LICENSING menu of the present invention after input of the Enabling Code.

This corresponding Enabling Code 31 may be manually or automatically input into the gaming machine 21 in the GAME LICENSING menu 53, as viewed in FIG. 10. Upon input of the Enabling Code "53489001346", for example, the enabling device 32 preferably prompts the gaming operator whether or not they wish to save the input code by selecting the "save" button 58. Should the gaming operator elect to save the Enabling Code 31, the enabling device 32 in the gaming machine 21 will commence analysis of the input Enabling Code.

In the preferred embodiment, the compatible encrypting/decrypting device 42 incorporated in the enabling device 32 of the EPROM chip set 41 decrypts the Enabling Code 31 to retrieve the content contained therein. Subsequently, the algorithms and code set instructions incorporated in the enabling device 32 employ the CPU board 40 of the gaming machine 21 to enable the specific game or games on the specific machine from which the corresponding Request Code 27 originated.

If this Enabling Code 31 is input into another gaming machine upon which the corresponding Request Code 27 did not originate, the selected game desired to be enabled for use could not be enabled. In this instance, for example, the processor of the CPU board together with the EPROM chip set 41 could not match the output machine ID component of the Enabling Code 31 with the Board ID of the receiving gaming machine. Similarly, if the output game identification component of the Enabling Code 31 does not correspond to the input game identification component of the originating Request Code 27, the selected game desired to be enabled for use would also not be enabled for operation.

Moreover, to distinguish between game vendors, each EPROM chip set 41 includes a vendor component or a separate vendor code unique to each vendor. Once a Request Code is generated, the vendor component is included in the Request Code to identify that vendor. Accordingly, to generate a corresponding Enabling Code, the gaming vendor may be required to input their designated vendor code to assure a match with the vendor code component of the Request Code. If the input vendor code does not match the vendor code component, a corresponding Enabling Code will not be generated. This additional security measure assures that other multiple-game vendors do not license the games of other game vendors.

The enabling device 32 preferably generates a Confirmation Code 60 to confirm proper entry of the Enabling Code 31. As an exemplary illustration in FIG. 10, the Confirmation Code 60 is viewed as "3867". In some instances, the Confirmation Code may be required by the manufacturer or game vendor to complete the licensing transaction.

In accordance with the present invention, one important informational component of the Enabling Code 31 is the output time period component which sets the term of operation of the licensed game. Once the proper Enabling Code enables operation of the selected electronic game, the time period of operation for that activated game may commence. In cooperation with the internal clock device 52 of the gaming machine, the period of operation will be tracked. For instance, at midnight of each day, the days remaining on each licensed game (e.g., as shown in FIG. 8) will be decreased by one day.

As mentioned, a licensing database will be generated by the enabling device 32 which contains the licensing information of all the games of the EPROM chip set 41. This database is preferably stored in a storage device, preferably an EEPROM residing in the motherboard (not shown) of the gaming machine, and is preferably updated during each power-up. The content of the information in the licensing database for each game may include pertinent information such as the Request Code, the Enabling Code, the Confirmation Code, as well as the time period remaining for the licensed operation.

The clock device 52 is preferably provided by a real time clock device which is configured to operate regardless of whether the gaming machine is powered up or not. Even if the gaming machine is turned-off for extended periods of time, the internal clock device 52 will monitor the time period for each license. Therefore, the licensing period will not be postponed if the machine is not operational. Upon power-up of the gaming machine, the license database will be automatically updated.

In an effort to deter internal clock manipulation to extend the license period of the licensed games, the present invention may incorporate several safeguards. For one, the real time clock may be configured to be reset only by a key chip. This inconvenience will deter most simple clock manipulations. A more effective deterrent, however, is to configure the enabling device 32 to clear the licensing database in the event the clock device 52 is reset backwards a predetermined number of times. Preferably, this predetermined number is about three (3) times which will enable the game operator to reset the time during daylight savings, and perhaps another time for clock accuracy. However, should the clock be reset backwards a third time in a row, the licensing database may be cleared or reset back to the default settings. In this event, the entire procedure for licensing the games may have to be repeated.

As set forth above, the Enabling Code 31 may include an output denomination component relating to the denomination accepted for the selected electronic game to be licensed. This component is particularly suitable for denomination dependent licenses where the denomination is a negotiated component. Hence, upon input of the Enabling Code 31, the output denomination component will control the denomination of the selected game. In the preferred form, the enabling device 32 may be configured to display a warning that the license database may be cleared in the event the gaming operator attempts to alter the negotiated denomination of the enabled game or games.

In accordance with the present invention, the enabled games may be selectively disabled at the discretion of the gaming operator. This operation may be performed employing essentially the same technique used to enable the electronically disabled games of EPROM chip set 41. For example, the operator selects the enabled electronic game from the LICENSING STATUS menu 50 of FIG. 8 to obtain a Request Code 27. If this enabling device configuration requires the input of a time period component in the Request Code, then this is figure is set for zero (0) days for the period of the license. For the enabling device configurations which do not require a time period component in the Request Code, then the period of zero (0) days for the license is input into the corresponding encoder device 28 by the licensor which is then incorporated into the Enabling Code. Upon input of the Enabling Code into the enabling device for that specific gaming machine, the newly input time period component will subsequently disable the selected electronic game.

Depending upon the negotiated agreement, the manufacturer or game vendor (i.e., the licensor) may credit back the gaming operator the unused portion of the license.

Similarly, an agreed upon license may be extended using the same technique. In this situation, however, the time period component of the Request Code, and the corresponding Enabling Code will be reset to the negotiated time period. Upon input of the Enabling Code into the enabling device for that specific gaming machine, the newly input time period component will subsequently reset the time period and re-enable the selected electronic game for the negotiated period of time.

In another aspect of the present invention, new game chips or even a new EPROM chip set may be installed without disrupting the licensing database. As mentioned above, the licensing database is preferably stored in an EEPROM device residing in the motherboard of the gaming machine. Accordingly, the installation of a new EPROM chip set or installation of new gaming chips will not disrupt the licensing database.

In accordance with the present invention, if one or more of the previously licensed games are not present in the new EPROM chip set or gaming chips, the enabling device together with the CPU board 40 will independently remove the license data in the license database relating to each game not present in the new chip set or game chips. However, if the previously licensed game is included in the new chip set, the enabling device will continue to update the data corresponding to that licensed game for enabled operation thereof.

Preferably, the present invention permits packaged licensing of two or more games so that a group of selected games or a prefixed group of games may be enabled through a single Request Code and corresponding Enabling Code. In this manner, a game operator may only be required to perform one licensing procedure in accordance with the present invention to license a plurality of games on a single gaming machine.

Finally, to assure the codes are input correctly, conventional CRC methods are employed over the codes.

4. Process Details

A preferred embodiment of the invention will now be described with reference to process flow diagrams in FIG. 3. The principal steps of the present inventive method begins at step 22 and proceed to step 23 which includes selecting an electronically disabled electronic game 25 from the gaming machine 21. The next step 26 includes generating a Request Code 27 representative of the particular selected electronic game 25 on the particular gaming machine 21 for input into an encoder device 28. After the Request Code generating step 26, the next step 29 includes receiving an Enabling Code 31, responsive to the Request Code 27 and calculated by the encoder device 28 specifically for the particular gaming machine 21. The final principal step 30 is provided by inputting the Enabling Code 31, representing information electronically enabling operation of the previously disabled electronic game 25 for that gaming machine 21, into the gaming machine 21 to enable operation of the selected game 25.

Figure 11:
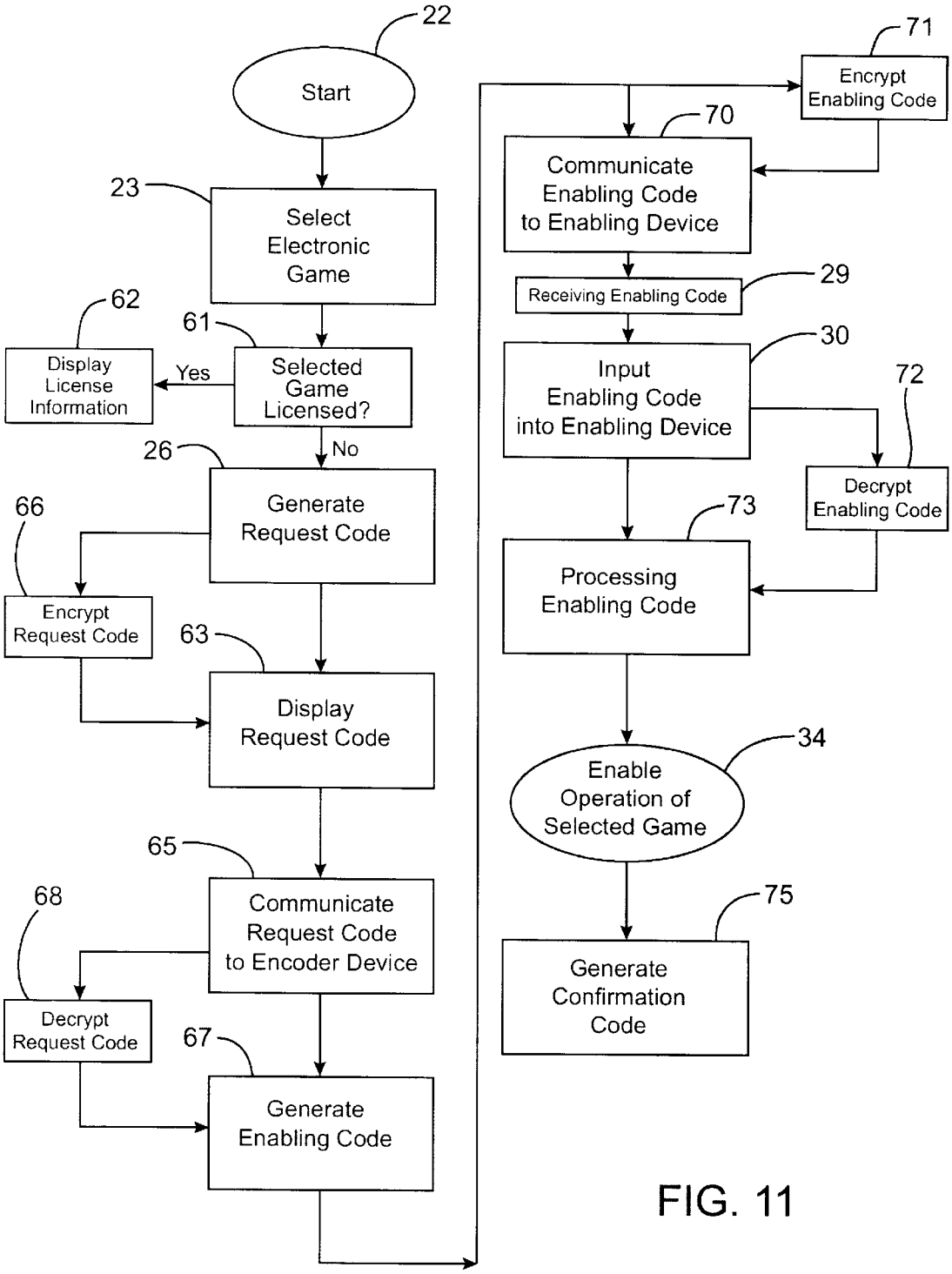
FIG. 11 is a detailed process flow diagram setting forth the steps employed in the electronic game licensing mechanism of the present invention.

Turning now to FIG. 11, a more detailed flow diagram of the present invention is illustrated. Between the selecting step 23 and the generating step 26, the enabling device 32 determines at step 61 whether the selected electronic game of step 23 is already licensed. If the selected game is already licensed, then the enabling device at step 62 displays the prominent licensing information on display 37. This is exemplified in the GAME LICENSING menu 53 of FIG. 10. On the other hand, if the selected game is not yet licensed, the enabling device 32 automatically generates a Request Code 27 at step 26. Subsequently, at step 63, the generated Request Code is displayed on the display screen 37 in the GAME LICENSING menu 53 of FIG. 9.

The generating step 26 further includes the step of generating an input machine identification component of the Request Code representative of the identification of particular gaming machine. The generating step 26 may also include the step of generating an input game identification component of the Request Code representative of the identification of particular selected game for enabling. In another embodiment of the present invention, the generating step 26 includes the step of generating an input time period component of the Request Code representative of a predetermined time for enabling use of the selected game. Depending upon the enabling device arrangement, the time period request may be manually input for incorporation into the Request Code. Finally, the generating step 26 may further include the steps of generating a time component and a date component of the Request Code representative of the time and date of generation of the Request Code.

After generation of the Request Code 27 at step 26, the Request Code is communicated at step 65 to the enabling device 32 through communication coupling 55. As set forth above, this communication may be performed through any communication medium including voice transmission, telephone, internet, wireless transmission, facsimile, hardwiring, etc.

Further, before the communication step 65 and/or before the display step 63, the present invention preferably encrypts the Request Code 27 at step 66 through an encrypting device 42 which is communicably coupled to the enabling device. The encrypted Request Code 27 may then be displayed in the GAME LICENSING menu 53 of FIG. 9.

Upon receiving the generated Request Code at step 29, the next step 67 includes generating an Enabling Code 31 responsive to the receipt of Request Code 27. The generated Enabling Code, of course, is specifically designated for operable receipt in the originating gaming machine, and is specifically directed toward the particular game caused to be enabled. Accordingly, the generating step of step 67 further includes the step of generating an output machine identification component, responsive to the input machine identification component of the Request Code, for enabling use on the originating gaming machine. This generating step 67 may further the step of generating an output game identification component, responsive to the input game identification component of the Request Code, for enabling use on the selected electronic game. Finally, the generating step 67 may include the step of generating a time period component for enabling use of the selected electronic game for a predetermined time period.

In accordance with the present invention, preferably before step 67 for generating the Enabling Code, the method includes the step 68 of decrypting the encrypted Request Code 27 through an encrypting/decrypting device 56 which is communicably coupled to the encoder device 28. Again, similar to the Request Code generation, once the Enabling Code is secured, the next step 70 includes communicably the Enabling Code from the encoder device 28 to the enabling device 32. Again, this step may be performed through any communication medium including voice transmission, telephone, internet, wireless transmission, facsimile, hardwiring, etc.

Before communicating the Enabling Code 31 to the communication coupling 55, the present invention preferably encrypts the Enabling Code at step 71 through encrypting/decrypting device 56 which is communicably coupled to the encoder device. Subsequently, the Enabling Code 31 is input into the enabling device of the gaming machine at step 30.

Again, after the inputting step 30, the encrypting/decrypting device 42 of the enabling device 32 preferably decrypts the encrypted Enabling Code at step 72. At step 73, the enabling device 32 and the CPU board 40 cooperate to process the components of the Enabling Code so that the selected electronic game may be enabled for operation at step 34.

As shown in the flow diagram of FIGS. 11, once the electronic game is properly enabled for operation at step 34, the method includes the step 75 of outputting or generating a confirmation signal 60 in response to proper receipt of the Enabling Code and enabling of the selected electronic game. This is preferably represented as an confirmation code, as exemplified in FIG. 10.

In accordance with the present invention, a real time clock device is included which is coupled to the enabling device to monitor the period for licensing of the selected electronic game. Upon surpassing a predetermined unit of time measured on the clock device 52, the enabling device 32 incrementally decreases the period for licensing the corresponding game by a predetermined licensing increment of time. For example, the predetermined unit of time may be a twenty-four (24) hour period as measured by the clock device 52. Once this predetermined unit of time has passed, the enabling device incrementally decreases the negotiated term of the license of the corresponding game by one day.

To prevent or deter clock device 52 manipulation in order to extend the period for licensing, several safeguards are imposed. For instance, upon manual resetting of the clock device 52 a predetermined number of times, the present method automatically disables use of the selected game by the enabling device. Such disabling is preferably performed by resetting the licensing database.

In an alternative embodiment of the present invention, the method for enabling use of at least one electronic game of a plurality of electronic games operably accessible from a gaming machine includes at step 29 receiving a Request Code 27 generated by the gaming machine 21, representing the identification of a selected, unlicensed electronic game on the particular gaming machine; and at step 30, inputting the received Request Code 27 into an encoder device 28. Responsive to the input Request Code 27, the present method includes the step 67 of generating an Enabling Code 31 representing data electronically enabling operation of the previously disabled electronic game for input into that particular gaming machine for licensed operation thereof.

What is claimed is:

1. A method for enabling use of at least one game of a plurality of games operably accessible from an electronic gaming machine, the method comprising the steps of:

(a) selecting a disabled game from the gaming machine;

(b) generating a Request Code representative of the selected game on the gaming machine for input into an encoder device;

(c) receiving an Enabling Code responsive to the Request Code and calculated by the encoder device specifically for the gaming machine; and (d) inputting the Enabling Code, representing information electronically enabling operation of the previously disabled game into the gaming machine to enable operation of the selected game.

2. The method of claim 1 wherein, said gaming machine is communicably coupled to an enabling device configured to generate said Request Code.

3. The method of claim 2 wherein, said generating step further includes the step of generating an input machine identification component of the Request Code representative of the identification of the gaming machine.

4. The method of claim 3 wherein, said generating step further includes the step of generating an input game identification component of the Request Code representative of the selected game to be enabled.

5. The method of claim 4 wherein, said generating step further includes the step of generating an input time period component of the Request Code representative of a predetermined time for enabling use of the selected game.

6. The method of claim 2 wherein, said generating step further includes the step of encrypting the Request Code through an encrypting device communicably coupled to said enabling device.

7. The method of claim 6 further including the step of:

before said receiving step, encrypting the Enabling Code.

8. The method of claim 1 further including the step of:

after the inputting step, outputting a confirmation signal representing the confirmation for enabling the selected game.

9. The method of claim 2 further including the step of:

before the generating step, inputting a time period for enabling use of the selected game for a predetermined time period.

10. The method of claim 9 further including the step of:

after inputting a time period, said enabling device generating an input time period component of the Request Code corresponding to the input predetermined time period.

11. The method of claim 10 wherein, said Enabling Code includes an output time period component, responsive to the input time period component of the Request Code, for enabling use of the selected game for a predetermined time period.

12. The method of claim 11 wherein, said enabling device includes a clock device responsive to the output time period component of the Enabling Code to enable use of the selected game for the predetermined time period.

13. The method of claim 12 further including the step of:

upon manual resetting of the clock device a predetermined number of times, automatically disabling use of said selected game by said enabling device.

14. The method of claim 12 wherein, said enabling device includes a licensing database containing information enabling the licensing of the corresponding games of the plurality of games enabled thereby; said method further including the step of:

upon resetting of the clock device a predetermined number of times, automatically disabling use of all enabled games by resetting the licensing database.

15. The method of claim 1 further including the step of:

calculating the Enabling Code by said encoder device through an encryption algorithm.

16. The method of claim 2 wherein, said enabling device includes a licensing database corresponding to all games of the plurality of games enabled thereby.

17. The method of claim 5 wherein, said Enabling Code further includes an output game identification component, responsive to the input game identification component of the Request Code, for enabling use of the selected game.

18. The method of claim 3 wherein, said Enabling Code further includes an output machine identification component, responsive to the input machine identification component of the Request Code, for enabling use of the selected game on the gaming machine.

19. The method of claim 5 wherein, said Enabling Code further includes an output time period component, responsive to the input time period component of the Request Code, for enabling use of the selected game for a predetermined time period on the gaming machine.

20. The method of claim 18 further including the step of:

determining whether to enable the disabled game on the gaming machine.

21. The method of claim 4 wherein, said determining step is performed by matching the output machine identification component of the Enabling Code with the machine identification of the gaming machine.

22. A method for enabling use of at least one game of a plurality of games resident on and selectively operable from a multiple-game platform gaming machine, the method comprising:

receiving a Request Code generated by the gaming machine, representing the identification of a selected, unlicensed game resident on the gaming machine; and responsive to the Request Code, generating an Enabling Code from an encoder device representing data electronically enabling operation of a previously disabled game for input into that gaming machine for licensed operation thereof.

23. The method of claim 22 further including the step of:

after the receiving step, inputting the received Request Code into said encoder device.

24. The method of claim 22 wherein, said generating step further includes the step of outputting an output machine identification component of the Enabling Code for enabling use of the unlicensed game on that particular gaming machine.

25. The method of claim 24 wherein, said generating step further includes the step of outputting an output game identification component of the Enabling Code for enabling use of the unlicensed game.

26. The method of claim 24 further including the step of:

determining whether to enable the disabled game on the gaming machine.

27. The method of claim 26 wherein, said determining step is performed by matching the output machine identification component of the Enabling Code with the machine identification of the gaming machine.

28. The method of claim 25 wherein, said generating step further includes the step of encrypting the Enabling Code through an encrypting device communicably coupled to said encoder device.

29. A gaming machine comprising:

a video display device;

an electronic multiple-game platform providing a plurality of independently operational games resident on the gaming machine, and having at least one disabled game operable on the video display device and selectively operable from the gaming machine; and an enabling device coupled to the multiple-game platform and configured to selectively generate a Request Code corresponding to the disabled game to enable operation thereof, and generated in response to a request to enable operation of said disabled game.

30. The gaming machine according to claim 29 further including:

an encoder device adapted to generate an Enabling Code generated in response to receipt of said Request Code to selectively enable the disabled game on the gaming machine upon receipt thereof by said enabling device.

31. The gaming machine according to claim 30 wherein, said Request Code includes an input game identification component corresponding to the at least one disabled game, and said Enabling Code includes an output game identification component, generated in response to receipt of the input game identification component of the Request Code, for enabling use of the disabled game.

32. The gaming machine according to claim 31 wherein, said Request Code includes an input machine identification component corresponding to the particular gaming machine, and said Enabling Code includes an output machine identification component, generated in response to receipt of the input machine identification component of the Request Code, for enabling use of the disabled game on the gaming machine.

33. The gaming machine according to claim 32 wherein, said Enabling Code includes an output time period component for enabling use of the disabled game for a predetermined period of time.

34. The gaming machine according to claim 33 further including:

a licensing database containing information enabling the licensing of the corresponding games of the plurality of games enabled thereby.

35. The gaming machine according to claim 34 further including:

a clock device responsive to the output time period component of the Enabling Code to enable use of the selected game for the predetermined time period, said clock device being coupled to said enabling device in a manner such that upon manual resetting thereof a predetermined number of times, said enabling device automatically resets said licensing database to disable use of the enabled game.

36. A gaming machine comprising:

a video display device;

an electronic multiple-game platform having at least one disabled game operable on the video display device and operably accessible from the gaming machine; and an enabling device coupled to the multiple-game platform and adapted to generate a Request Code having an input game identification component corresponding to the at least one disabled game, said enabling device further being configured to selectively enable the disabled game upon receipt of an Enabling Code including an output game identification component, generated in response to receipt of the input game identification component of the Request Code, for enabling use of the disabled game.

37. The gaming machine according to claim 36 further including:

an encoder device adapted to generate said Enabling Code which is communicably coupled to said enabling device.

38. The gaming machine according to claim 36 wherein, said Enabling Code includes an output time period component for enabling use of the disabled game for a predetermined period of time.

39. The gaming machine according to claim 38 further including:

a clock device responsive to the output time period component of the Enabling Code to enable use of the selected game for the predetermined time period, said clock device being coupled to said enabling device in a manner such that upon manual resetting thereof a predetermined number of times, said enabling device automatically disabling use of the enabled game.

40. The gaming machine according to claim 36 further including:

a licensing database containing information enabling the licensing of the corresponding games of the plurality of games enabled thereby.

* * * * *